United States Patent [19]

Collins

[11] 4,391,437

[45] Jul. 5, 1983

[54] DOOR HOLDING CLAMP

[76] Inventor: William T. Collins, Rte. 4, Box 340, Lillington, N.C. 27546

[21] Appl. No.: 200,231

[22] Filed: Oct. 24, 1980

[51] Int. Cl.[3] ..... B25B 1/00

[52] U.S. Cl. ..... 269/254 CS; 269/905

[58] Field of Search ..... 24/252 R, 263 SB, 263 R; 269/254 R, 254 CS, 158, 905, 228

[56] References Cited

U.S. PATENT DOCUMENTS

| | | | |
|---|---|---|---|
| 164,232 | 6/1875 | Tandy | 269/254 CS |
| 611,340 | 9/1898 | Smith . | |
| 670,446 | 3/1901 | Fletcher et al. | 24/263 SB |
| 708,238 | 9/1902 | Lucabaugh . | |
| 849,354 | 4/1907 | Adams . | |
| 1,067,667 | 7/1913 | Lynch . | |
| 1,606,634 | 11/1926 | Hinds . | |
| 2,471,103 | 5/1949 | Franks et al. . | |
| 2,491,972 | 12/1949 | Halote | 269/254 |
| 2,566,656 | 9/1951 | David | 269/254 CS |
| 2,605,795 | 8/1952 | Tracy . | |
| 2,651,959 | 9/1953 | Harrington | 269/228 |
| 2,830,632 | 4/1958 | LaRouche . | |
| 2,958,760 | 11/1960 | McNally | 24/263 SB |
| 4,054,280 | 10/1977 | Alberts . | |
| 4,219,910 | 9/1980 | Kruska et al. | 24/263 SB |

FOREIGN PATENT DOCUMENTS

| | | | |
|---|---|---|---|
| 1244679 | 7/1967 | Fed. Rep. of Germany | 269/254 CS |

*Primary Examiner*—Robert C. Watson

*Attorney, Agent, or Firm*—Dowell & Dowell

[57] ABSTRACT

A clamp apparatus for holding a door or the like in a generally vertical plane while a workman is preparing the door for hanging within a frame. The apparatus includes a base having a pair of clamping members slidably mounted thereon and such members are connected to a foot operated lever which is operated to move the clamping members apart and a spring or other resilient member urges the clamping members toward each other.

6 Claims, 6 Drawing Figures

Fig. 1
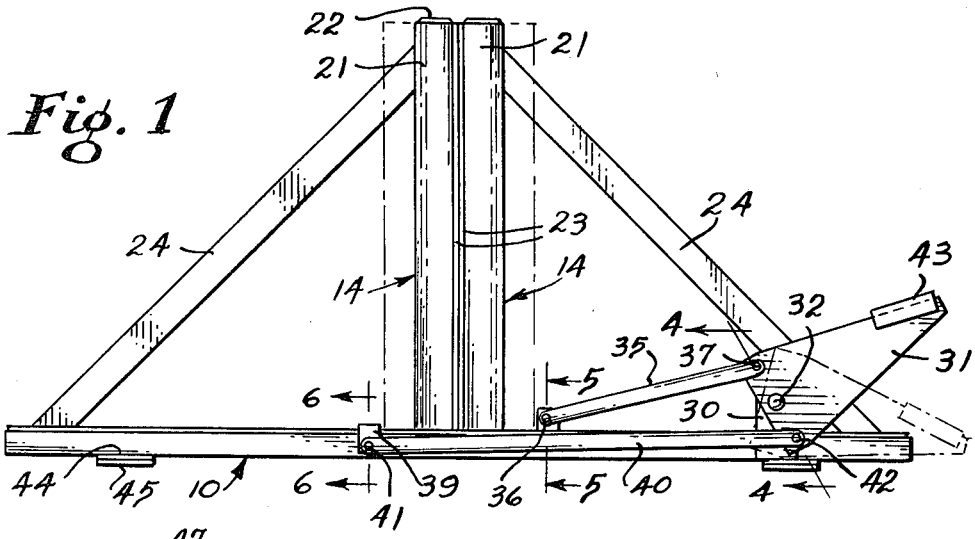
Fig. 2
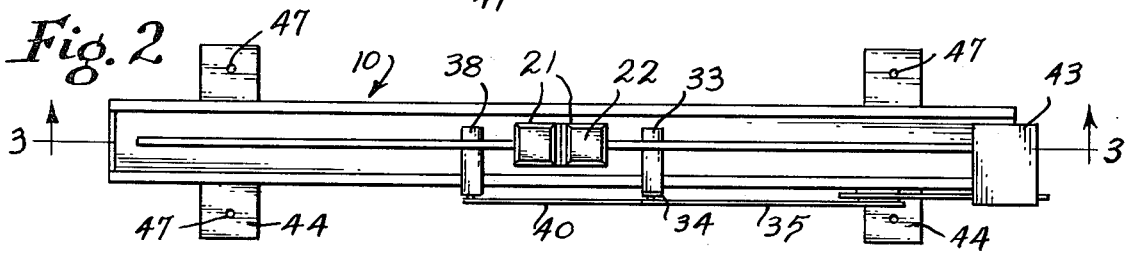
Fig. 4
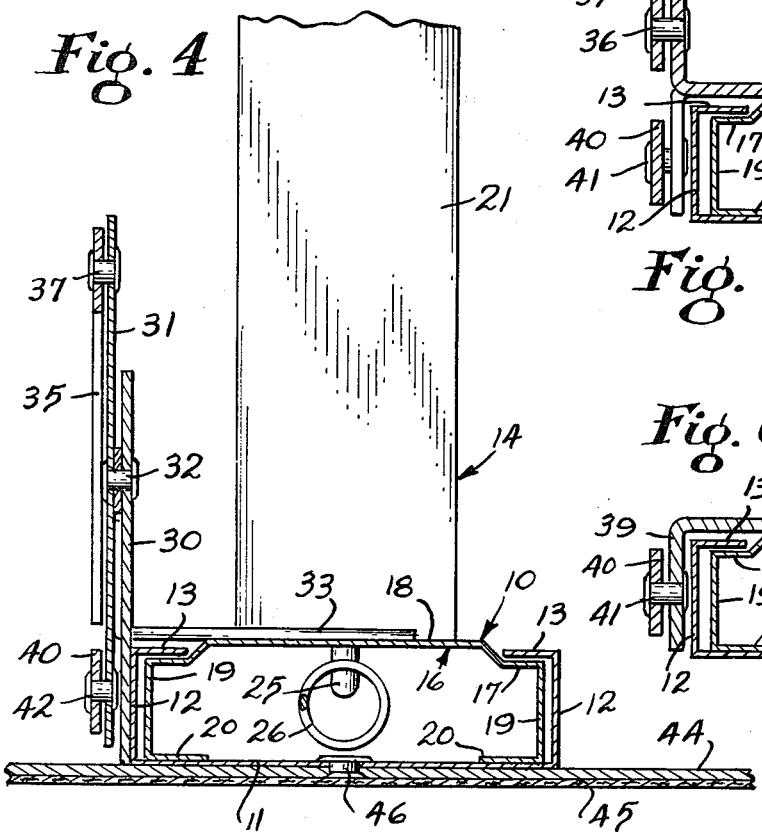
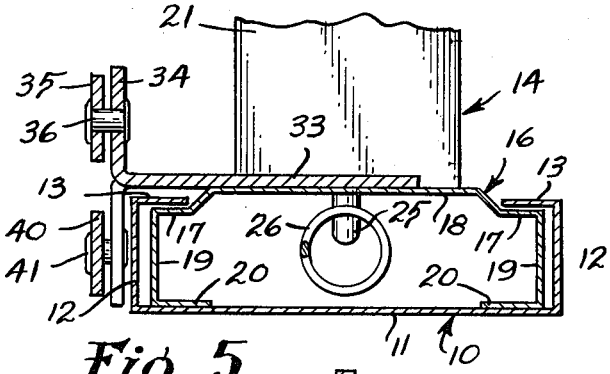
Fig. 5
Fig. 6
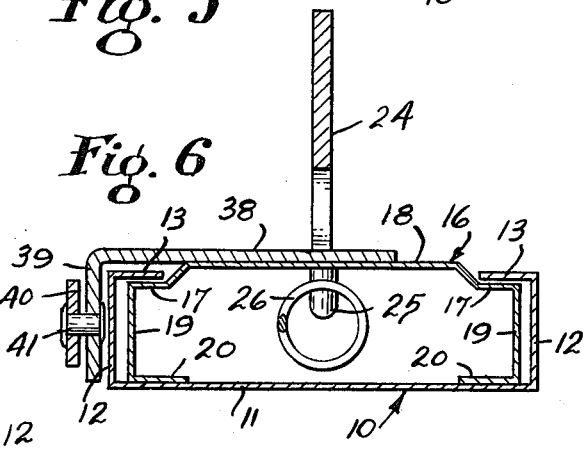

DOOR HOLDING CLAMP

TECHNICAL FIELD

This invention relates generally to work holders and relates specifically to work holders having a pair of clamping members which are selectively spread apart by a mechanical force to receive a workpiece after which the clamping members are urged into clamping engagement with the workpiece by a resilient member such as a spring or the like to hold such workpiece in fixed position.

BACKGROUND ART

In the past, many work holders have been provided for holding doors, panels and other relatively thin unwieldy objects in an upright position to facilitate trimming the edges, insetting locks and hinge plates and performing other work associated with hanging the door in a frame or the like. In earlier door holders, a base was provided with upstanding clamp members and at least one of such clamp members was slidably moved by hand relative to the other to clamp and release the workpiece. Some examples of this type of structure are shown by the U.S. Pat. Nos. to Smith 611,340; Lucabaugh 708,238; Adams 849,354; Lynch 1,067,667; and Hinds 1,606,634. In later door and other work holders, a base was provided with one or more swingable or sliding clamping members associated with a workpiece support so that when the workpiece was placed on the support, the weight of the workpiece caused the clamping members to move into engagement therewith. This type of structure is disclosed in the U.S. Pat. Nos. to Tracy 2,605,795; and LaRouche 2,830,632. Also, the U.S. Pat. No. 4,054,280 to Alberts discloses a clamping member which engages a workpiece by fluid pressure and U.S. Pat. No. 2,471,103 to Franks et al discloses a work holder which holds a relatively small workpiece by spring pressure.

DISCLOSURE OF INVENTION

The present invention is embodied in a work holder for a door or other workpiece and includes a base on which a pair of clamping members are slidably mounted and such clamping members are urged toward each other by a spring or other resilient member. Additionally, the clamping members are connected by links to a foot operated lever so that a downward force on a portion of the lever causes the clamping members to move apart to permit a workpiece to be inserted between such members and when the downward force is relieved, the clamping members are urged into intimate clamping engagement with the workpiece by the resilient member. After the work on the workpiece has been completed, a downward force on the portion of the lever releases the workpiece so that it may be removed from the holder.

BRIEF DESCRIPTION OF THE DRAWINGS

FIG. 1 is a side elevational view of the Door Holding Clamp.

FIG. 2 is a top plan view thereof.

FIG. 4 is an enlarged sectional view taken along the line 4—4 of FIG. 1.

FIG. 5 is an enlarged sectional view taken along the line 5—5 of FIG. 1.

FIG. 6 is an enlarged sectional view taken along the line 6—6 of FIG. 1.

BEST MODE FOR CARRYING OUT THE INVENTION

Figure 3:
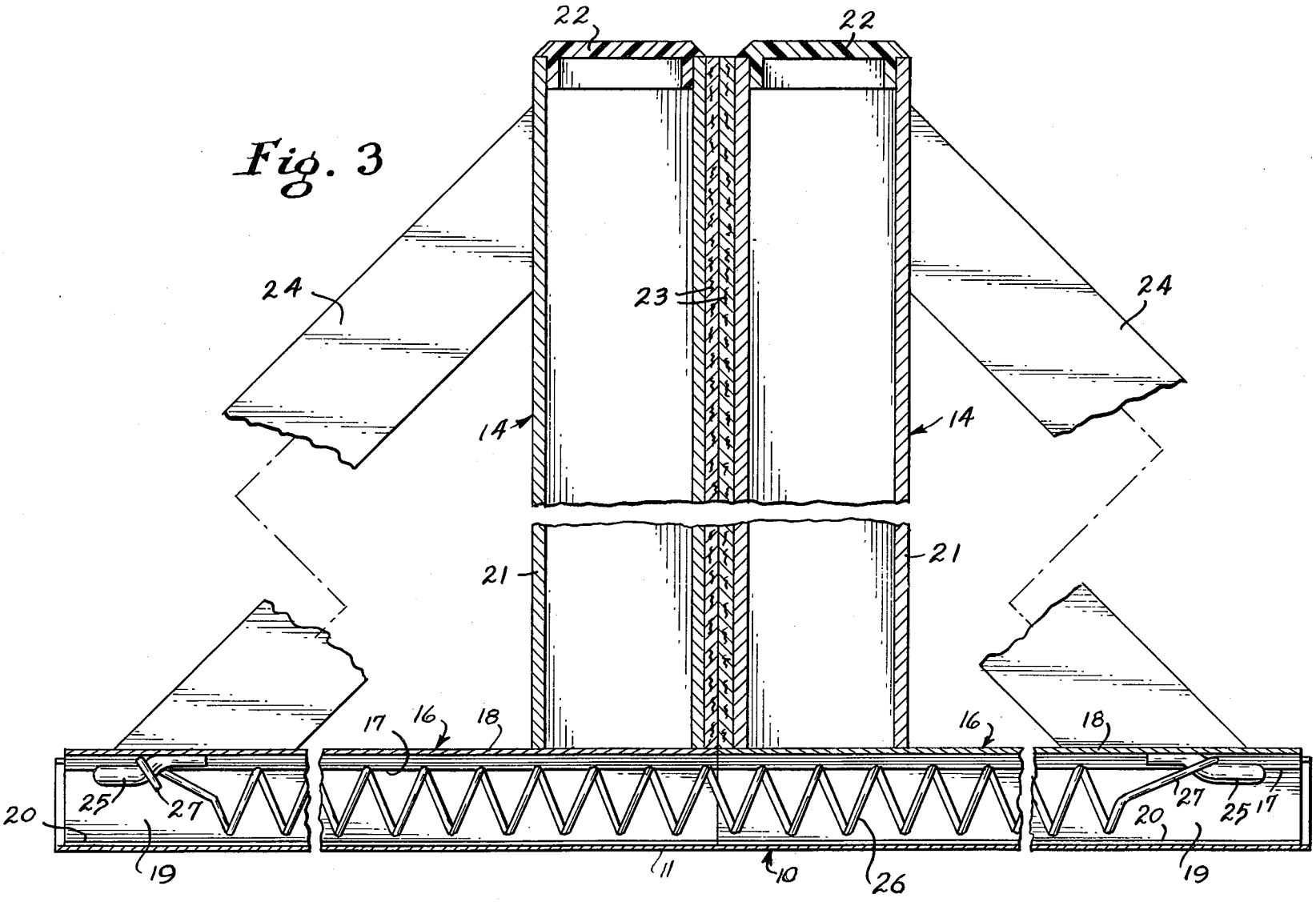
FIG. 3 is an enlarged fragmentary sectional view taken along the line 3—3 of FIG. 2.

With continued reference to the drawings, an elongated hollow generally U-shaped base 10 is provided, having a bottom wall 11, side walls 12 and upper flanges 13 which extend inwardly toward each other. A pair of clamp members 14 are slidably mounted within the base 10 and each of such clamp members includes a hollow body 16 which is slidably mounted within the base 10. As illustrated best in FIGS. 4–6, such body includes an upper wall 17 that is positioned below the flanges 13 and has a raised central portion 18 which extends upwardly above such flanges. A pair of side walls 19 are integrally connected to the wall 17 and the lower edges of such side walls terminate in flanges or runners 20 which extend inwardly toward each other and slidably engage the bottom wall 11 of the base. The runners 20 are relatively narrow to reduce the frictional engagement with the bottom wall 11 of the base.

The innermost ends of the bodies 16 normally are substantially in contiguous relationship with each other. A hollow post 21, which is generally square in cross section, is fixed adjacent to the innermost end of each of the bodies 16 and extends upwardly along a generally vertical axis. Preferably, the upper end of each post 21 is closed by a cap 22. The facing sides of each of the posts 21 has a resilient non-slip strip or pad 23 attached thereto in any desired manner such as adhesives, clips, fasteners or the like and such strips are in abutting relationship with each other when no workpiece is present and engage opposite sides of the workpiece when such workpiece is inserted into the apparatus. The upper ends of the posts 21 are connected to the other ends of their respective bodies 16 by a brace 24 to support and rigidify such posts.

In order to urge the bodies 16 toward each other, particular attention is directed to FIG. 3. Each of the bodies is provided with an offset outwardly extending finger or lug 25, the innermost end of which is mounted on the central portion 18 of the body and the outer end is spaced downwardly therefrom. A coiled tension spring or other resilient member 26 extends substantially through the bodies 16 and the opposite ends of such spring are formed into hooks 27 which engage the fingers 25 and urge the bodies 16 toward each other.

Since the spring 26 constantly urges the bodies toward each other, it is important to provide an apparatus for spreading the posts 21 apart to permit a workpiece such as a door, panel, window sash or the like to be positioned between the posts. In order to do this, a support plate 30 is welded or otherwise attached to one of the side walls 12 of the base 10 and extends upwardly substantially above the same. An elongated generally triangular lever 31 is connected by a pivot pin 32 to the upper portion of the support plate 30 with such pivot pin being located adjacent to the central portion of one edge of the lever.

An anchor 33 is fixed to the central portion 18 of the clamp member nearest to the support plate 30 and such anchor has an upwardly extending side or flange 34 to which one end of a link 35 is connected by a pivot pin 36. The other end of the link 35 is connected to one corner of the lever 31 by a pivot pin 37. An anchor 38 is fixed to the central portion of the clamp member remote from the support plate 30 and includes a downwardly extending flange 39 located in spaced generally parallel relationship with the side of the base 10. A link 40 has one end connected to the flange 39 by a pivot pin 41 and the opposite end is connected by a pivot pin 42 to the corner of the lever 31 which is remote from the pivot pin 37.

A foot pedal 43 is welded or otherwise attached to the end of the lever 31 remote from the pivot pin 32 and extends in a plane generally normal to the plane of the lever. As shown in FIGS. 1 and 2, the foot pedal extends above and in spaced relationship to the base 10. If desired, a resilient non-slip pad may cover the upper surface of the foot pedal 43.

It is preferred that the base 10 be stabilized so that the clamp does not tip over when in use and this is done by providing a pair of stabilizing plates 44 adjacent to opposite ends of the base. Such plates usually are provided with resilient non-skid pads 45 on their lower surfaces. As illustrated best in FIG. 4, the stabilizing plates 44 are rotatably mounted on the bottom wall 11 of the base by pivot pins 46, however, it is contemplated that the plates 44 could be permanently or temporarily attached to the base by welding, clips, fasteners, or the like. When the stabilizer plates are pivotally mounted, the longitudinal axis may be disposed generally normal to the longitudinal axis of the base when in use and generally parallel to such axis when the apparatus is being stored or shipped. Also, the stabilizer plates 44 have openings 47 located on each side of the base so that the device may be temporarily fixed to a floor or other foundation by fasteners such as nails extending through one or more of the openings 47.

INDUSTRIAL APPLICABILITY

When the device is to be used, the stabilizer plates 44 are rotated from a position generally parallel with the base 10 to a position at right angles thereto and, if desired, such plates may be secured to a foundation. When a door, panel or other workpiece is brought to the device, such workpiece is frequently of such size, weight and unwieldiness that both hands of the operator are required to hold and manipulate the workpiece. While holding the workpiece, the operator places his foot on the pedal 43 and exerts a downward force which causes the lever 31 to rotate about the pivot pin 32. This rotational force applies a pulling force on the upper link 35 and a pushing force on the link 40 and causes the clamp members to move in opposite directions away from each other against the tension of the spring 26. When the clamp members are moved apart, the workpiece is turned on edge with the portion to be worked on located uppermost and the workpiece is lowered onto the base 10. Thereafter, the downward force on the foot pedal 43 is relieved and the spring 26 moves the clamp members toward each other until the pads 23 on the posts 21 intimately engage and hold the workpiece in substantially fixed position. Inward movement of the clamp members 14 causes the lever 31 to rotate toward its upper position. When the work has been completed, a downward force on the foot pedal 43 spreads the clamp members apart so that the workpiece may be removed and when the downward force is relieved, the spring urges the clamp members toward each other until the pads 23 are in abutting relationship.

I claim:

1. Apparatus for clamping a workpiece in a position so that work may be performed thereon comprising an elongated hollow base having a pair of opposed flanges at the top, said flanges extending inwardly toward each other and defining an opening, a pair of clamp members slidably mounted on said base, each of said clamp members including a body having portions underlying said flanges, each of said clamp members having a post fixed to said body and extending upwardly between said flanges of said base, spring means connecting said clamp members and urging said posts toward abutting relationship, an upstanding support plate means mounted on said base adjacent to one end, lever means rotatably mounted on said support plate means, a first link connecting one of said clamp members to one side of said lever means, a second link connecting the other clamp member to the other side of said lever means, and means for rotating said lever means, whereby movement of said lever means in one direction causes said first and second link means to move said clamp members in opposite directions against the tension of said spring means and when said movement of said lever means is relieved said spring means moves said clamp members toward each other.

2. The invention of claim 1 including stabilizer plate means carried by said base to substantially prevent said base from tipping over.

3. An apparatus for holding a workpiece comprising an elongated base member having top and bottom portions, a pair of opposed clamp members, said clamp members having first portions engaging said base member and second portions extending upwardly beyond said top portion of said base member, said clamp members being slideably moveable relative to each other along said base member, means for continuously urging said clamp members toward an abutting relationship with each other, lever means attached to said base member, first link means connecting said lever means to one of said clamp members and second link means connecting said lever means to the other of said clamp members whereby a force applied to said lever means causes said clamp members to be moved apart relative to one another and when the force on said lever means is relieved said means for continuously urging said clamp members causes said clamp members to move toward one another so that a workpiece may be selectively engaging therebetween.

4. The invention of claim 3 including at least one stabilizer means pivotally connected to said base member.

5. The invention of claim 4 in which each of said clamp members includes a brace member angularly extending and connecting said first and second portions thereof.

6. Apparatus for holding a workpiece comprising an elongated generally hollow base having an opening at the top, a pair of clamp members having first means engaging said base and second means extending outwardly beyond the opening in the top of said base and remotely therefrom for engaging the workpiece above said base, said clamp members being slideably movable along said base and longitudinally of said opening, means within said base for continuously urging said clamp members toward abutting relationship with one another, lever means pivotally mounted to said base, first link means connecting said lever means to one of said movable clamp members, second link means connecting said lever means to the other of said clamp members, said lever means being pivotally connected to said base, said first and second link means being connected on opposite sides of the pivotal connection of said lever means with said base, whereby first and second link means will be moved in opposite directions upon the movement of said lever means.

* * * * *